US005526756A

United States Patent [19]

Watson

[11] Patent Number: 5,526,756

[45] Date of Patent: Jun. 18, 1996

[54] ADJUSTABLE COMPUTER DESK

[76] Inventor: David J. Watson, 104 Woodhaven Dr., Greencastle, Ind. 46135

[21] Appl. No.: 371,960

[22] Filed: Jan. 12, 1995

[51] Int. Cl.[6] ..... A47B 9/00

[52] U.S. Cl. ..... 108/147; 108/50; 312/223.3

[58] Field of Search ..... 108/50, 147, 144; 312/194, 223.3

[56] References Cited

U.S. PATENT DOCUMENTS

| | | | |
|---|---|---|---|
| 3,938,766 | 2/1976 | Herbolsheimer et al. | 108/147 X |
| 4,735,467 | 4/1988 | Wolters | 312/223.3 X |
| 4,805,538 | 2/1989 | Fisher et al. | 108/147 X |
| 4,852,500 | 8/1989 | Ryburg et al. | 312/223.3 X |
| 5,071,204 | 12/1991 | Price et al. | 312/194 |
| 5,101,736 | 4/1992 | Bommarito et al. | 312/194 X |
| 5,289,782 | 3/1994 | Rizzi et al. | 108/147 |
| 5,322,025 | 6/1994 | Sherman et al. | 108/147 |
| 5,437,235 | 8/1995 | Randolph | 312/223.3 X |

*Primary Examiner*—José V. Chen

[57] ABSTRACT

A desk for adjustably supporting a computer keyboard and monitor at desired heights. The inventive device includes a desk having a monitor platform and a keyboard platform supported within apertures extending through an upper surface of the desk. Platform height adjustment assemblies are mounted to the platforms for adjustably positioning the platforms relative to the upper surface of the desk.

3 Claims, 4 Drawing Sheets

FIG. 1
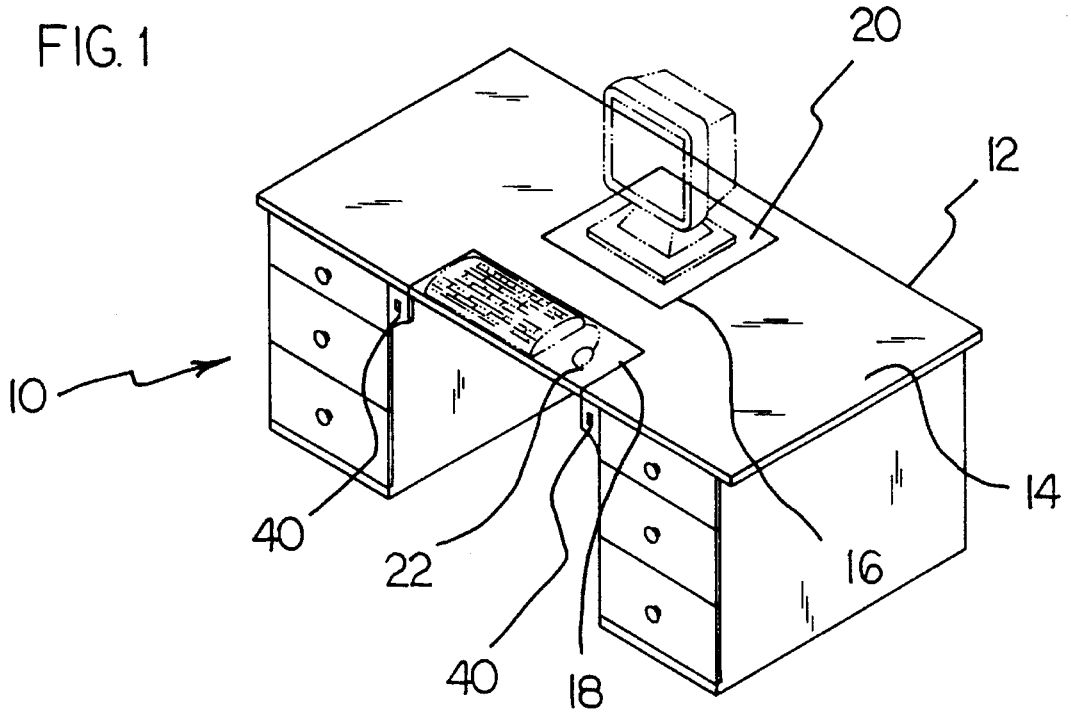
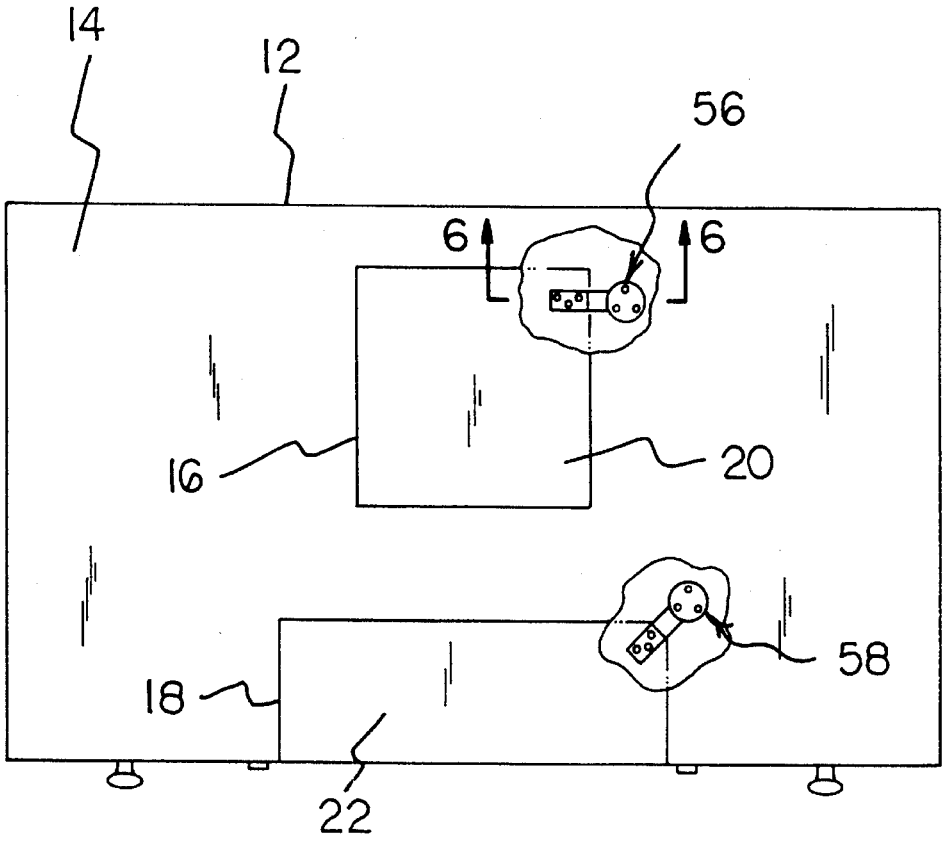
FIG. 2

FIG. 3
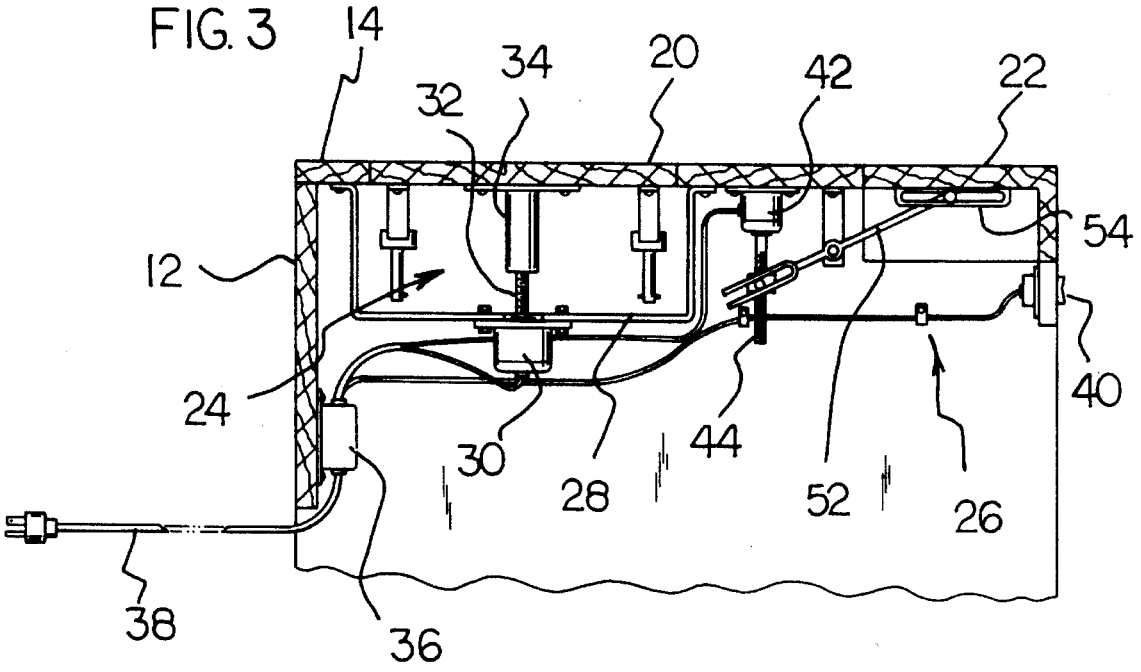
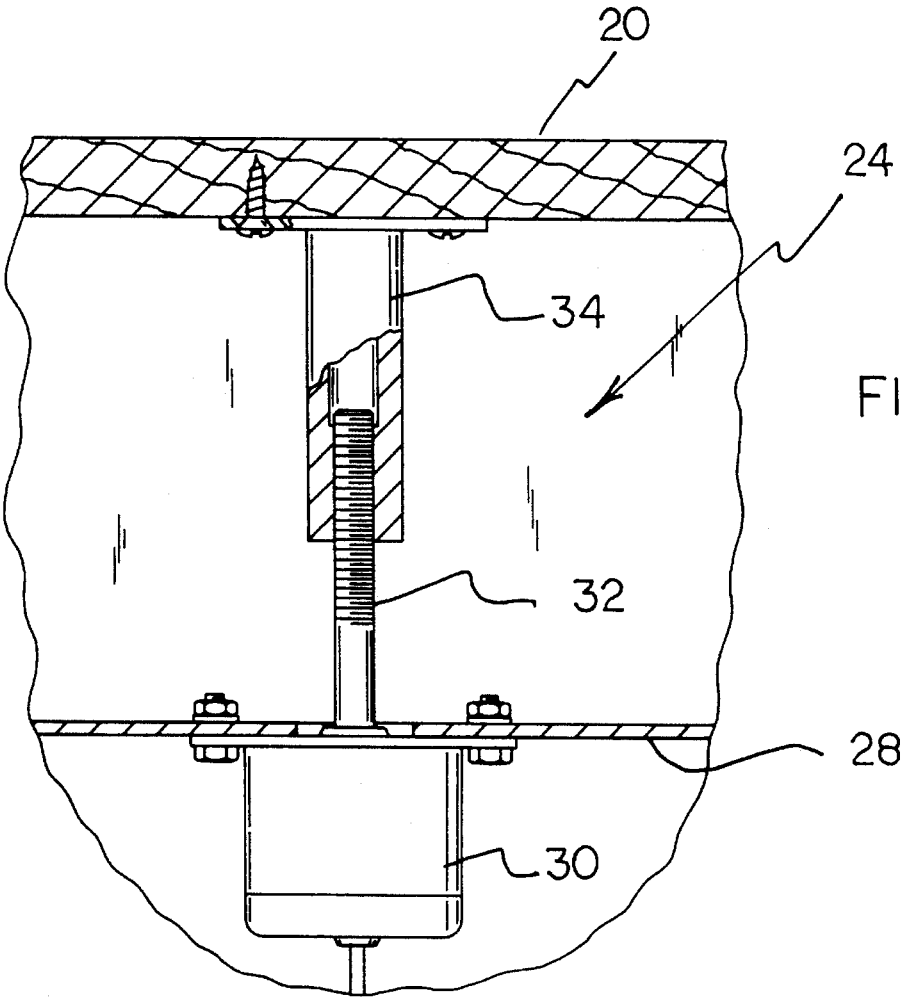
FIG. 4

ADJUSTABLE COMPUTER DESK

BACKGROUND OF THE INVENTION

1. Field of the Invention

The present invention relates to desk structures and more particularly pertains to an adjustable computer desk for adjustably supporting a computer keyboard and monitor at desired heights.

2. Description of the Prior Art

The use of desk structures is known in the prior art. More specifically, desk structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art desk structures include U.S. Pat. No. 5,121,974; U.S. Pat. No. 5,071,204; U.S. Pat. No. 4,925,240; U.S. Pat. No. 4,766,422; U.S. Pat. No. Design 327,780; and U.S. Pat. No. Design 284,147.

While these devices fulfill their respective, particular objectives and requirements, the aforementioned patents do not disclose an adjustable computer desk for adjustably supporting a computer keyboard and monitor at desired heights which includes a desk having a monitor platform and a keyboard platform supported within apertures extending through an upper surface of the desk, and platform height adjustment assemblies mounted to the platforms for adjustably positioning the platforms relative to the upper surface of the desk.

In these respects, the adjustable computer desk according to the present invention substantially departs from the conventional concepts and designs of the prior art, and in so doing provides an apparatus primarily developed for the purpose of adjustably supporting a computer keyboard and monitor at desired heights.

SUMMARY OF THE INVENTION

In view of the foregoing disadvantages inherent in the known types of desk structures now present in the prior art, the present invention provides a new adjustable computer desk construction wherein the same can be utilized for adjustably supporting computer hardware. As such, the general purpose of the present invention, which will be described subsequently in greater detail, is to provide a new adjustable computer desk apparatus and method which has many of the advantages of the desk structures mentioned heretofore and many novel features that result in a adjustable computer desk which is not anticipated, rendered obvious, suggested, or even implied by any of the prior art desk structures, either alone or in any combination thereof.

To attain this, the present invention generally comprises desk for adjustably supporting a computer keyboard and monitor at desired heights. The inventive device includes a desk having a monitor platform and a keyboard platform supported within apertures extending through an upper surface of the desk. Platform height adjustment assemblies are mounted to the platforms for adjustably positioning the platforms relative to the upper surface of the desk.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable computer desk apparatus and method which has many of the advantages of the desk structures mentioned heretofore and many novel features that result in a adjustable computer desk which is not anticipated, rendered obvious, suggested, or even implied by any of the prior art desk structures, either alone or in any combination thereof.

It is another object of the present invention to provide a new adjustable computer desk which may be easily and efficiently manufactured and marketed.

It is a further object of the present invention to provide a new adjustable computer desk which is of a durable and reliable construction.

An even further object of the present invention is to provide a new adjustable computer desk which is susceptible of a low cost of manufacture with regard to both materials and labor, and which accordingly is then susceptible of low prices of sale to the consuming public, thereby making such adjustable computer desks economically available to the buying public.

Still yet another object of the present invention is to provide a new adjustable computer desk which provides in the apparatuses and methods of the prior art some of the advantages thereof, while simultaneously overcoming some of the disadvantages normally associated therewith.

Still another object of the present invention is to provide a new adjustable computer desk for adjustably supporting a computer keyboard and monitor at desired heights.

Yet another object of the present invention is to provide a new adjustable computer desk which includes a desk having a monitor platform and a keyboard platform supported within apertures extending through an upper surface of the desk, and platform height adjustment assemblies mounted to the platforms for adjustably positioning the platforms relative to the upper surface of the desk.

Even still another object of the present invention is to provided a new adjustable computer desk wherein the platform height adjustment assemblies are electrically operated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of an adjustable computer desk according to the present invention in use.

FIG. 2 is a top plan view, partially in cross section, of the invention.

FIG. 3 is a cross sectional view of the invention.

FIG. 4 is an enlarged cross section view of a portion of a monitor platform height adjustment means of the invention.

DESCRIPTION OF THE PREFERRED EMBODIMENT

Figure 5:
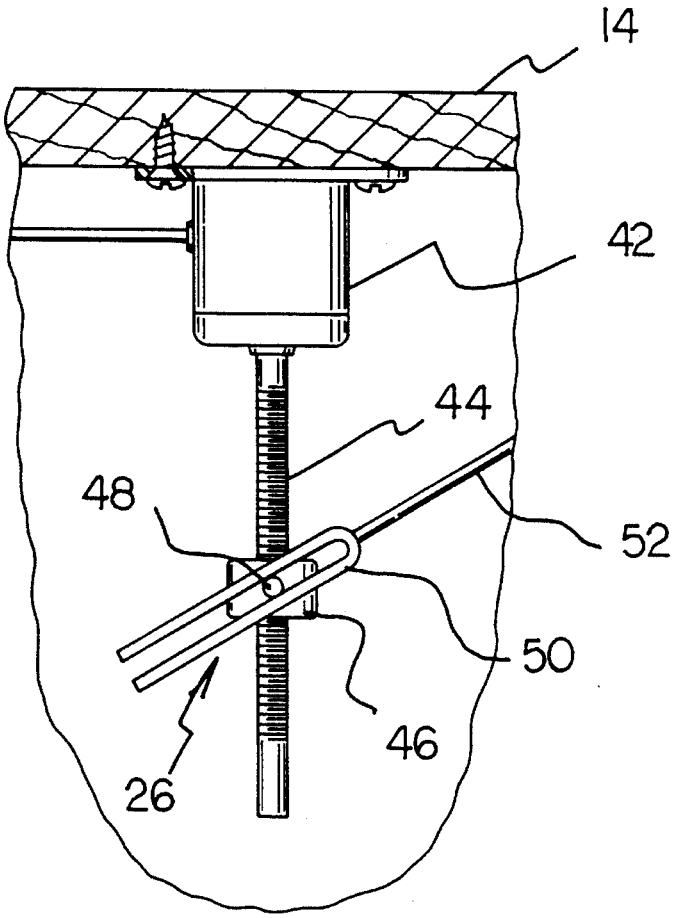
FIG. 5 is an enlarged cross sectional view of a portion of a keyboard platform height adjustment means of the invention.

With reference now to the drawings, and in particular to FIGS. 1–8 thereof, a new adjustable computer desk embodying the principles and concepts of the present invention and generally designated by the reference numeral 10 will be described.

More specifically, it will be noted that the adjustable computer desk 10 comprises a desk 12 of any desired configuration having an upper surface 14 supported in a spaced relationship relative to a ground surface upon which the desk resides. The upper surface 14 of the desk 12 is shaped so as to define a monitor aperture 16 extending therethrough and a keyboard aperture 18 also extending through the upper surface. A monitor platform 20 is positioned within the monitor aperture 16, with a keyboard platform 22 being similarly positioned within the keyboard aperture 18. As shown in FIG. 3, the present invention 10 further comprises a monitor platform height adjustment means 24 for adjustably positioning the monitor platform 20 relative to the upper surface 14 of the desk 12. Further, a keyboard platform height adjustment means 26 is provided with the invention 10 for adjustably positioning the keyboard platform 22 relative to the upper surface 14 of the desk. By this structure, an individual can selectively position the monitor platform 20 and the keyboard platform 22 relative to the upper surface 14 of the desk 12 as desired to support a computer monitor and a computer keyboard, respectively, at desired heights relative to the upper surface.

Figure 8:
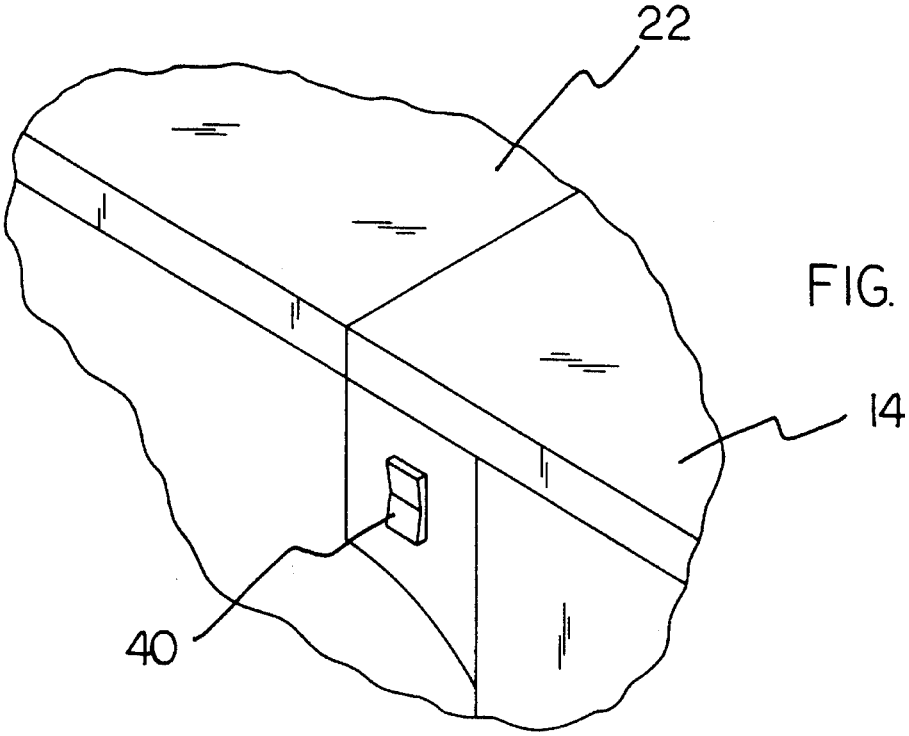
FIG. 8 is an enlarged isometric illustration of a portion of the invention illustrating a control switch thereof.

As best illustrated in the cross section views of FIGS. 3 and 4, it can be shown that the monitor platform height adjustment means 24 according to the present invention 10 preferably comprises a motor bracket 28 mounted beneath the upper surface 14 of the desk 12 so as to extend across the monitor aperture 16. A monitor motor 30 is mounted to the bracket 28 and includes a motor shaft projecting towards the monitor platform 20. A threaded rod 32 is mounted to the motor shaft of the monitor motor 30 and threadably engages a threaded receiver 34 mounted to a lower surface of the monitor platform 20. The monitor motor 30 is electrically coupled to a control box 36 having a power cord 38 extending therefrom. A control switch 40, as shown in FIG. 8 for example, is electrically coupled to the control box 36 for effecting selective energization of the monitor motor 30 in both forward and reverse directions. By this structure, the monitor motor 30 can be selectively energized to rotate the threaded rod 32 so as to position the monitor platform 20 relative to the upper surface 14 of the desk 12. It should be noted that the monitor platform 20 is capable of being positioned below the upper surface 14 of the desk 12, or alternatively above the upper surface as desired.

Referring now to FIG. 5 with concurrent reference to FIG. 3, it can be shown that the keyboard platform height adjustment means 26 according to the present invention 10 preferably comprises a keyboard motor 42 mounted beneath the upper surface 14 of the desk 12. The keyboard motor 42 includes an unlabeled motor shaft, with a threaded rod 44 projecting from the motor shaft of the keyboard motor. As shown in FIG. 5, a threaded collar 46 is threadably engaged to the threaded rod 44 of the keyboard motor 42 and includes a projection 48 extending into a yoke 50 of a pivot rod 52. The pivot rod 52 is pivotally mounted beneath the upper surface 14 of the desk 12 and engages an elongated bracket 54 mounted beneath the keyboard platform 22. Another control switch 40, as shown in FIG. 1, is electrically coupled to the control box 36 and can be selectively actuated to operate the keyboard motor 42. By this structure, an energization of the keyboard motor 42 will effect axial movement of the threaded collar 46 along the threaded rod 44 to rotate the pivot rod 52 and cause a subsequent positioning of the keyboard platform 22 relative to the upper surface 14 of the desk 12. It should be noted that the keyboard platform 22 can be positioned beneath the upper surface 14, or alternatively, can be positioned above the upper surface 14 of the desk 12 as desired.

Figure 6:
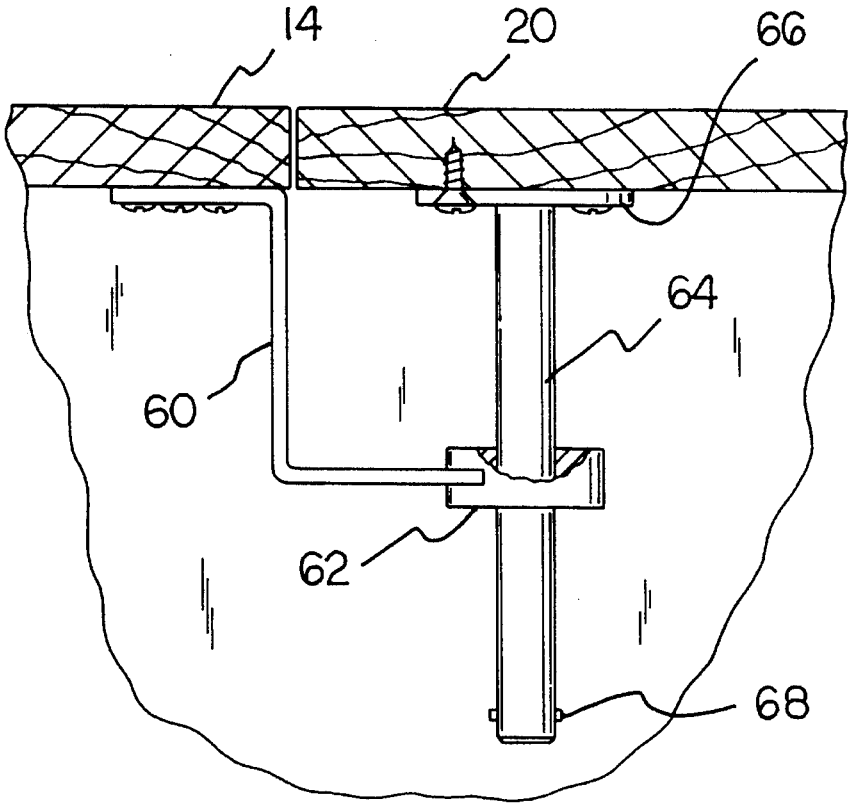
FIG. 6 is a cross sectional view taken along line 6—6 of FIG. 2.
Figure 7:
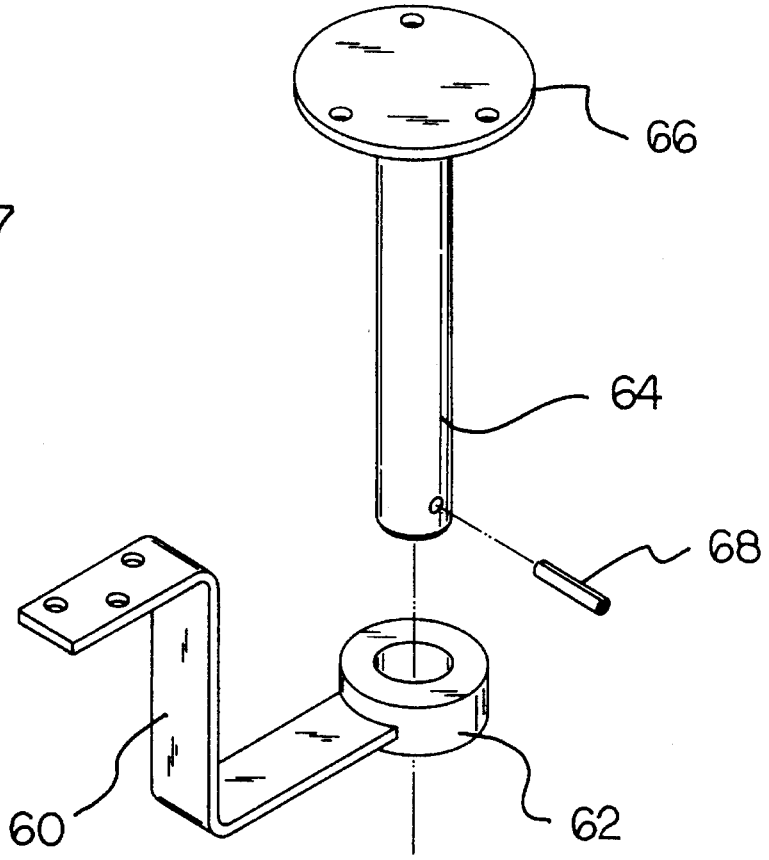
FIG. 7 is an exploded isometric illustration of a guide means of the present invention.

As shown in FIGS. 2, 6, and 7, the present invention 10 may further comprise a monitor platform guide means 56 coupled to the monitor platform 20 and the upper surface 14 for guiding the monitor platform into a parallel orientation relative to the upper surface. Similarly, a keyboard platform guide means 58 can be provided with the invention 10 for guiding the keyboard platform 22 in a parallel orientation relative to the upper surface 14 of the desk 12. As shown in FIG. 6 and 7, the guide means 56 and 58 are substantially similar in design and configuration and each comprise a support bracket 60 mounted beneath the upper surface 14 of the desk 12 which supports a sliding collar 62 in a substantially spaced and parallel orientation relative to the upper surface. A vertical guide rod 64 orthogonally projects from a mounting plate 66 which is secured to a lower surface of the respective platform 20 or 22. The vertical guide rod 64 projects through the sliding collar 62 to thus guide the respective platform 20 or 22 into a substantially parallel orientation relative to the upper surface 14. A securing pin 68 is preferably directed through an aperture in a lower distal end of the vertical guide rod 64 to preclude unintentional separation of the vertical guide rod 64 from the sliding collar 62.

In use, the adjustable computer desk 10 according to the present invention can be easily utilized to adjustably support a computer keyboard and a monitor at a desired height.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A adjustable computer desk comprising:

a desk having an upper surface, the upper surface of the desk being shaped so as to define a monitor aperture and a keyboard aperture extending therethrough;

a monitor platform height adjustment means comprising a motor bracket mounted beneath the upper surface of the desk so as to extend across the monitor aperture; a monitor motor mounted to the bracket and including a motor shaft protecting towards the monitor platform; a threaded rod mounted to the motor shaft of the monitor motor; and a threaded receiver mounted to a lower surface of the monitor platform and threadably engaged with the threaded rod, wherein the monitor motor can be selectively activated to rotate the threaded rod so as to position the monitor platform relative to the upper surface of the desk; and a keyboard platform height adjustment means comprising a keyboard motor mounted beneath the upper surface of the desk, the keyboard motor including a motor shaft; a threaded rod projecting from the motor shaft of the keyboard motor; a threaded collar threadably engaged to the threaded rod, the collar including a projection extending therefrom; a pivot rod pivotally mounted beneath the upper surface of the desk, the pivot rod including a yoke through which the projection extends; an elongated bracket mounted to a bottom surface of the keyboard platform, the pivot rod being slidably engaged to the elongated bracket, wherein an activation of the keyboard motor will effect axial movement of the threaded collar along the threaded rod to rotate the pivot rod relative to the desk to cause a subsequent positioning of the key board platform relative to the upper surface of the desk.

2. The adjustable computer desk of claim 1, and further comprising platform guide means coupled to the platforms and the upper surface for guiding the platforms into a parallel orientation relative to the upper surface.

3. The adjustable computer desk of claim 2, wherein the guide means each comprise a support bracket mounted beneath the upper surface; a sliding collar mounted to the support bracket so as to be positioned in a substantially spaced and parallel orientation relative to the upper surface; and a vertical guide rod orthogonally projecting from the respective platform through the sliding collar to guide the respective platform into a substantially parallel orientation relative to the upper surface.

* * * * *